US008049126B2

(12) United States Patent
Chen et al.

(10) Patent No.: US 8,049,126 B2
(45) Date of Patent: Nov. 1, 2011

(54) SELF-ADJUSTING PLUG-IN LINE TERMINAL

(75) Inventors: Hai Chen, Duluth, GA (US); John D. Stephenson, Roswell, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 492 days.

(21) Appl. No.: 12/364,588

(22) Filed: Feb. 3, 2009

(65) Prior Publication Data

US 2009/0200271 A1 Aug. 13, 2009

Related U.S. Application Data

(60) Provisional application No. 61/026,231, filed on Feb. 5, 2008, provisional application No. 61/098,843, filed on Sep. 22, 2008.

(51) Int. Cl.
*H01H 73/04* (2006.01)

(52) U.S. Cl. ..... 200/400; 200/244; 335/6

(58) Field of Classification Search ..... 200/400–401, 200/244, 293; 355/6
See application file for complete search history.

(56) References Cited

U.S. PATENT DOCUMENTS

| | | | | |
|---|---|---|---|---|
| 3,573,415 | A | 4/1971 | Gryctko | |
| 4,970,481 | A * | 11/1990 | Arnold et al. | 335/6 |
| 5,302,787 | A * | 4/1994 | Edds et al. | 200/401 |
| 6,323,448 | B1 | 11/2001 | Glabau et al. | |
| 6,812,423 | B1 * | 11/2004 | Rodgers et al. | 200/400 |
| 7,005,594 | B2 * | 2/2006 | Kim | 200/244 |
| 7,217,895 | B1 * | 5/2007 | Shea et al. | 200/244 |
| 7,586,052 | B2 * | 9/2009 | Adunka et al. | 200/293 |

FOREIGN PATENT DOCUMENTS

EP 0168596 A2 1/1986

* cited by examiner

*Primary Examiner* — Truc Nguyen

(57) ABSTRACT

A line terminal for a circuit breaker includes a body forming two opposing legs and a third leg. The opposing legs are configured to form a passage for receiving a stab from a panel board. The two opposing legs are biased toward each other, and each of the opposing legs has a convex surface facing the passageway for engaging and maintaining alignment of the stab. A fixed contact is attached to the third leg. The fixed contact connects to a moveable contact of a circuit breaker. An arc runner is connected to the third leg and at least partially encloses a perimeter of the fixed contact.

18 Claims, 5 Drawing Sheets

SELF-ADJUSTING PLUG-IN LINE TERMINAL

RELATED APPLICATION INFORMATION

This application claims priority to provisional application Ser. No. 61/026,231 filed on Feb. 5, 2008, and provisional application Ser. No. 61/098,843 filed on Sep. 22, 2008, both incorporated herein by reference.

BACKGROUND

1. Technical Field

This disclosure relates to electrical connectors and more particularly, to a plug-in line terminal capable of self-adjustment in circuit breakers.

2. Description of the Related Art

In general, plug-in style line terminals play an important role in a circuit breaker. Line terminals provide a connection point between the circuit breaker and a stab or contact point of a circuit panel. Line terminals provide electric power, dissipate heat generated from an internal circuit, retain a stationary contact, and perform other functions. Conventional plug-in line terminal designs are more sensitive in applications with higher rating circuit breakers due to unstable connecting resistances. It is important to have a good connection design especially for heavy duty plug-in line terminals.

Line terminals are designed to be an interface between an external power supply (circuit panel) and an internal movable contact of the circuit breaker. Any additional and undesirable mechanical forces applied to the line terminal could result in a poor connection either internally or externally in the circuit breaker. Consequently, a total resistance of the circuit breaker is altered by such forces. This gives rise to temperatures increases on the line terminal or adjacent circuitry.

Conventional designs assume that centerlines of the line terminal and the stab line up with each other. In fact, due to the tolerances of stab assemblies in the panel board, the centerlines do not line up as intended. This can result in misalignment when the line terminal connects with the stab. This misalignment as well as inconsistent contact surface behavior can result in the generation of unwanted mechanical forces, and increased resistance (and heat generation). Therefore, the electric conductivity and the heat transfer characteristics may not always be consistent.

SUMMARY OF THE INVENTION

A line terminal for a circuit breaker includes a body forming two opposing legs and a third leg. The opposing legs are configured to form a passage for receiving a stab from a panel board. The two opposing legs are biased toward each other, and each of the opposing legs has a convex surface facing the passageway for engaging and maintaining alignment of the stab. A fixed contact is attached to the third leg. The fixed contact connects to a moveable contact of a circuit breaker. An arc runner is connected to the third leg and at least partially encloses a perimeter of the fixed contact.

A circuit breaker includes a moveable contact connected to an arm and configured to move to cause an open circuit in accordance with a current condition. A line terminal has a body forming two opposing legs and a third leg. The opposing legs are configured to form a passage for receiving a stab from a panel board. The two opposing legs are biased toward each other, and each of the opposing legs has a convex surface facing the passageway for engaging and maintaining alignment of the stab. A fixed contact is attached to the third leg, and the fixed contact connects to the moveable contact. An arc runner is connected to the third leg and at least partially encloses a perimeter of the fixed contact.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

A self-adjusting plug-in line terminal for circuit breakers is provided in accordance with the present principles. The circuit breakers which include the line terminal are particularly useful for residential or commercial use. The circuit breaker products are also particularly useful for 100 A or above ratings and 65 KA or higher interruption ratings. It should be noted that circuit breakers with any ratings or interruption ratings can benefit from the present principles.

In accordance with one embodiment, a self-adjusting plug-in line terminal tolerates assembly and construction errors without changes of even a Millivolt rating in the circuit breaker from line terminal to load terminal. Therefore, temperature changes are limited when the circuit breaker is loaded. In addition, an arc runner attached on the line terminal body helps to improve performance of current interruption and prevents erosion of a stationary contact of the circuit breaker.

To minimize variations of the connecting behavior, a double convex contact surface on the side of the line terminal is provided. This double convex contact surface ensures that the line terminal always remains connected to the stab so that in line touching on both sides of the stab exists no matter what the variations of the stab orientation in the panel board may be.

A reverse current path is also provided in the line terminal. The reverse current path has a long nose that is not only to retain a stationary contact and arc runner but also to create a magnetic repulsion force to open the movable contact as soon as a fault current appears. An arc runner is attached on the long nose of a body of the line terminal that moves any arcing from the contact to an arc chamber when the arc occurs during a fault current. The arc runner bridges the arc away from the contact. In one embodiment, the arc runner is formed from a steel material, which is durable for arcing processes.

The present embodiments will illustratively be described in terms of line terminals for circuit breakers; however the present embodiments are not limited to the illustrative example and may be employed with other electrical devices or contact systems. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the diagrams presented herein represent conceptual views of illustrative system components and/or circuitry embodying the principles of the invention.

Figure 1:
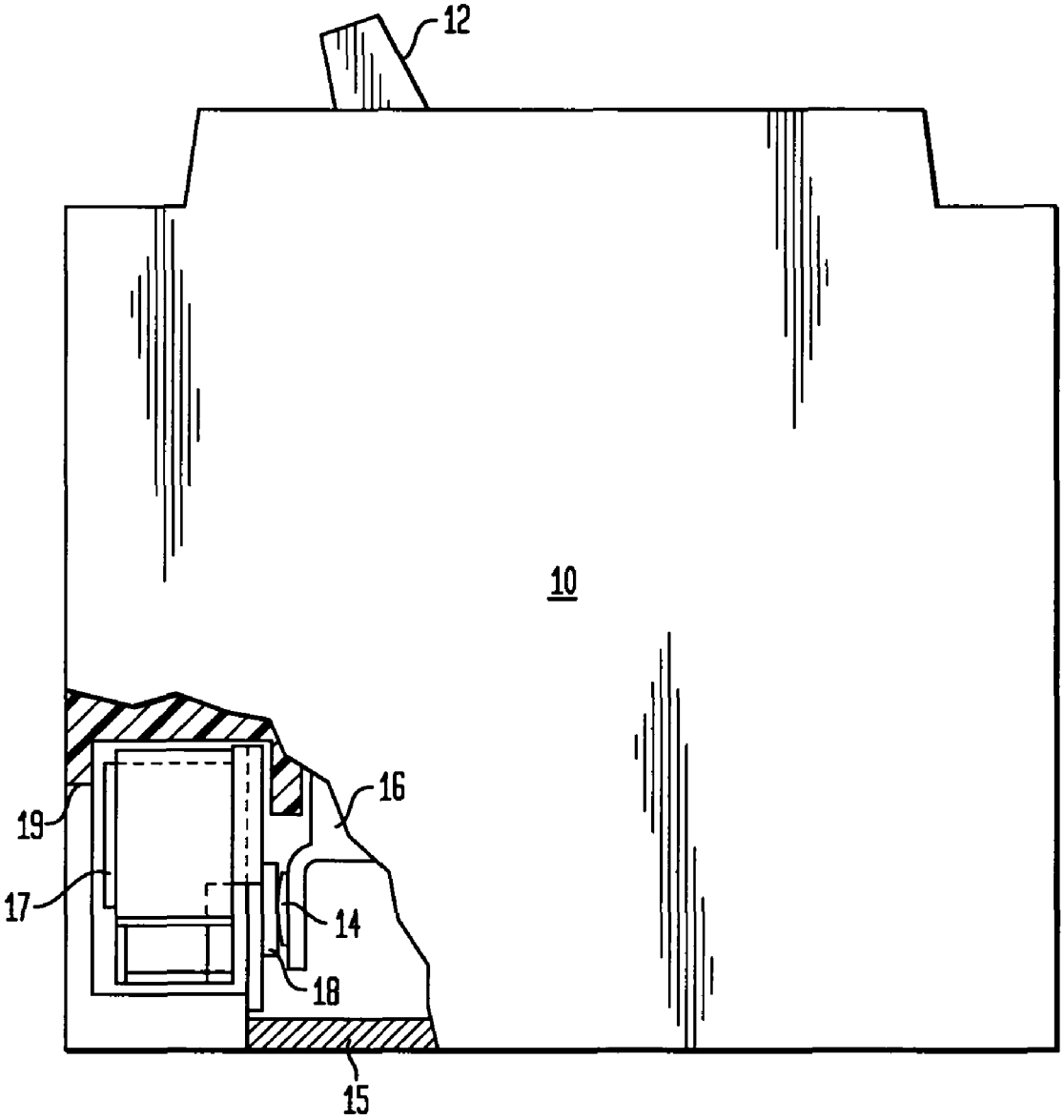
FIG. 1 is a diagram showing a circuit breaker with a portion of the housing removed to show a line terminal in accordance with an illustrative embodiment.

Referring now in specific detail to the drawings in which like reference numerals identify similar or identical elements throughout the several views, and initially to FIG. 1, a illustrative circuit breaker 10 is provided with a handle 12 for operating a circuit breaker mechanism (not shown) which includes a movable contact 14 that is mounted at the lower end of a movable arm 16 and is shown in a closed position with a stationary contact 18. A line terminal 17 is located in a housing 15 of the circuit breaker 10, the terminal being adjacent to and in alignment with an opening 19 in the housing.

The opening 19 is provided in the housing to provide a window for interacting with a stab (not shown) of an electrical panel (circuit panel).

Figure 2:
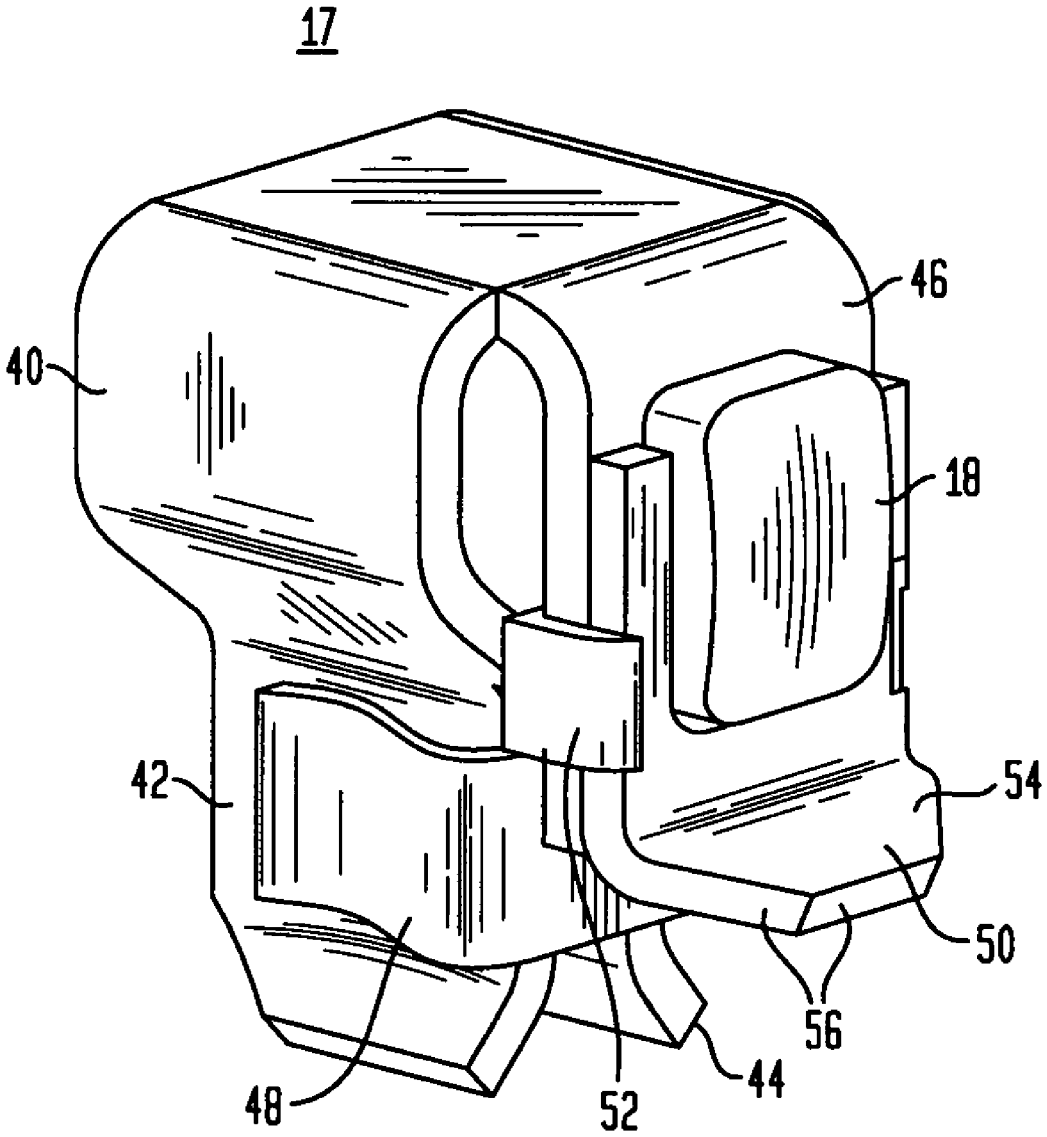
FIG. 2 is a perspective view of a line terminal in accordance with an illustrative embodiment.

Referring to FIG. 2, a line terminal 17 is shown in accordance with one illustrative embodiment. The line terminal 17 includes a body 40. The body 40 is preferably formed from a highly conductive material such as copper or a copper alloy. Other conductive materials may also be employed. The body 40 includes three legs 42, 44 and 46. Two legs 42 and 44 are formed in a "U" shape to create opposing sides for connecting to a stab (not shown). The opposing legs 42 and 44 form a passageway therebetween for receiving the stab of a panel board.

A third leg 46 is formed to mount a fixed or stationary contact 18. The legs 42 and 44 are adapted to receive a spring clip 48 or other biasing mechanism to bias the legs 42 and 44 toward each other. This provides a compression load on the stab once assembled for operation.

In addition, the third leg 46 is formed to provide a spring load against the moveable contact 14 and moveable arm 16 such that when the moveable arm 16 (FIG. 1) is tripped, a force is enhanced by the spring loading of the leg 46. Further, the spring clip 48 may be configured to supply or supplement this spring load to permit further support or to further the reaction time and movement of the moveable contact 14 and arm 16 during a trip condition. In this way, movement of the arm 16 can occur as quickly as possible during an interruption event.

An arc runner 50 is provided with tabs 52. Tabs 52 engage leg 46 to provide a mounting position thereon. Arc runner 50 is formed to at least partially encapsulate the perimeter of the fixed contact 18. The arc runner 50 may be formed from a ferromagnetic material, such as steel. Arc runner 50 is configured to provide a reverse current path in the line terminal 17. The reverse current path due to arcing advantageously creates a magnetic repulsion force to help open the movable contact 14 (FIG. 1) as soon as a fault current appears.

Arc runner 50 draws any arcing away from the contact 18 during current surges or interruptions. The arcing may be directed into an arcing chamber (not shown) or the like. Further, arc runner 50 also helps prevent erosion of the fixed contact 18 and the line terminal body 40.

There are other advantages of the arc runner 50 as well. For example, the arc runner 50 could be a self-welding fixture and can be welded while the arc runner 50 is crimped into notches 70 (FIG. 6) of leg 46 before welding the contact 18 onto leg 46. This design could save manufacturing welding fixtures as well as reduce welding time. The "U" profile of the arc runner 50 is not only around the contact 18 but also permits applying higher percentage of Silver contact material, such as AgC4 contact material. The more Silver content in the contact 18, the softer the contact 18 is. As long as the arc runner 50 can contain the contact material during operations and interruptions, the circuit breaker can continue to provide a good electrical connection.

Arc runner 50 may include a sloped surface 54 configured to assist in redirecting arcs away from the line terminal 40. An edge portion 56 may be faceted or otherwise shaped in a way configured to redirect arcing.

In one embodiment, contact 18 includes a material that provides low resistance and little or no contact sticking so that the moveable contact 14 (FIG. 1) is easily disengaged from the fixed contact 18 during a circuit breaker trip. In one useful embodiment, the contact 18 includes, e.g., AgC4 (contains 96% Silver and 4% Graphite). For each specific application the Graphite percentage may be changed, e.g., the range could be 3% to 5% in the low voltage circuit breaker design. This material has good electrical conductivity, low contact resistance, high fusion welding resistance, zero fusion under short circuit currents, and a good sliding ability. Other, suitable materials are also contemplated. Since the material of contact 18 may be soft, arc runner 50 helps to hold the contact material in the "U" shaped, partially or fully encapsulated perimeter of the contact 18.

Figure 3:
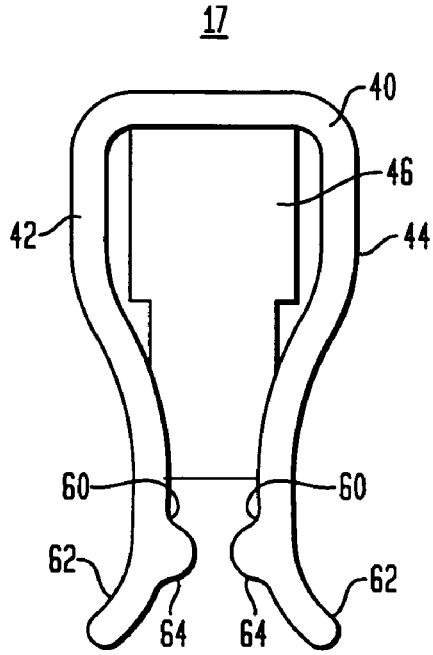
FIG. 3 is a back view of the line terminal of FIG. 2 without a stab inserted therein.
Figure 4:
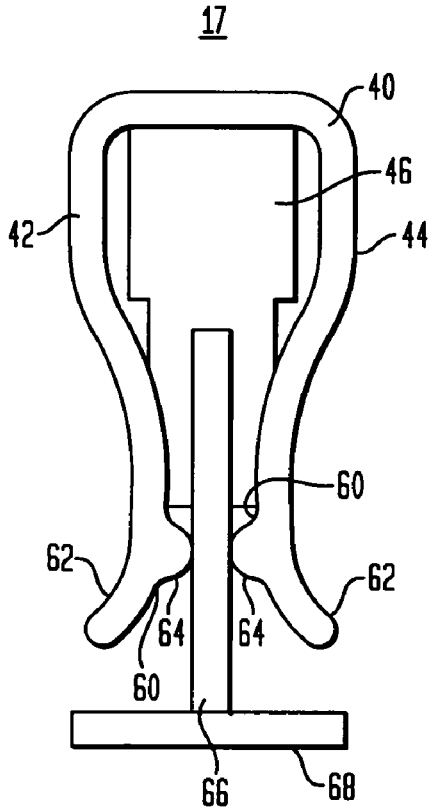
FIG. 4 is a back view of the line terminal of FIG. 2 with a stab inserted in a passageway between biased opposing legs and engaging protrusions in the passageway.

Referring to FIGS. 3 and 4, back views of the body 40 of the line terminal 17 are illustratively depicted. FIG. 3 shows the line terminal without a stab 66 inserted, and FIG. 4 shows the line terminal 17 with a stab 66 inserted. The legs 42 and 44 include convex surfaces 60 to assist in self-adjusting the connection between the circuit breaker and the stab 66. The convex surfaces 60 may be provided with convex or raised surfaces 64 to further improve the contact between the line terminal 17 and the stab 66. Legs 42 and 44 include angled portions 62 to permit the stab 66 to be more easily received in the line terminal 17. When assembled with the stab 66, the legs 42 and 44 of the line terminal 17 will be biased inwardly toward each other using a spring clip (not shown). In this way, the legs 42 and 44 have their free ends drawn together to press against the stab 66 to improve self-adjustment, ensure a good connection to the stab 66 and provide better alignment between the line terminal 17 and the stab 66. The stab 66 connects to a panel board 68, which provides electricity for a circuit serviced by the circuit breaker.

Figure 5:
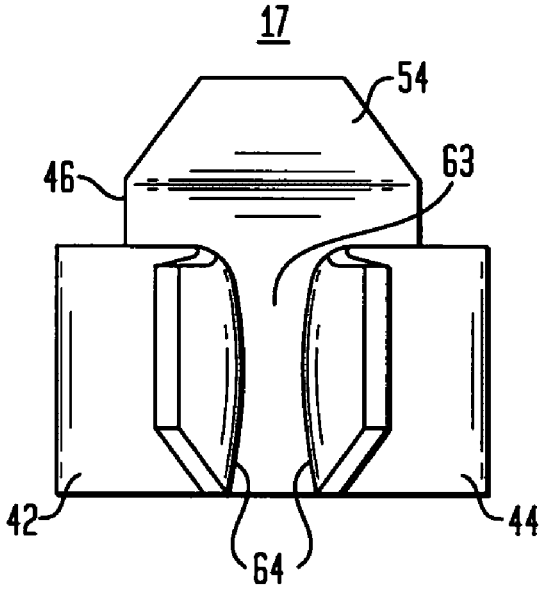
FIG. 5 is a bottom view of the opposing legs showing convex surfaces for engaging a stab in accordance with one illustrative embodiment.

Referring to FIG. 5, a bottom view of the line terminal 17 is illustratively shown in accordance with one embodiment. Convex surfaces 64 are biased as a result of biasing legs 42 and 44 together. This ensures alignment of the stab in a passageway 63 formed between the legs 42 and 44 when the stab is inserted.

Figure 6:
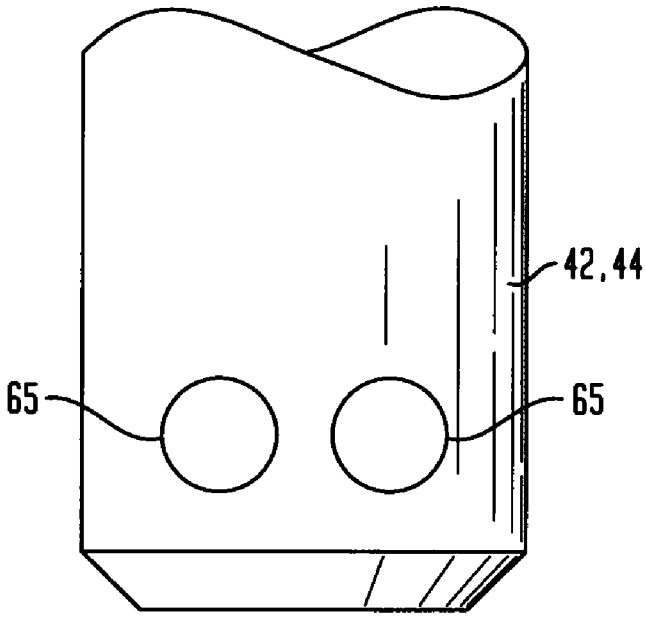
FIG. 6 is a view of an inside of one of the opposing legs showing protrusions for engaging a stab in accordance with another illustrative embodiment.

Referring to FIG. 6, an inside view of one of the two legs 42 and 44 is illustratively depicted in accordance with another embodiment. In one embodiment, a plurality of convex protrusions 65 is provided. These protrusions 65 are preferably aligned perpendicular to the direction of insertion of the stab 66 (FIG. 4). In this way, a more stable and accurate alignment is provided between the stab 66 and the legs 42 and 44. The protrusions 64 are preferably employed on both legs 42 and 44 such that the plurality of protrusions 64 are configured to eliminate or reduce twist or misalignment between the stab 66 and the legs 42 and 44.

Figure 7:
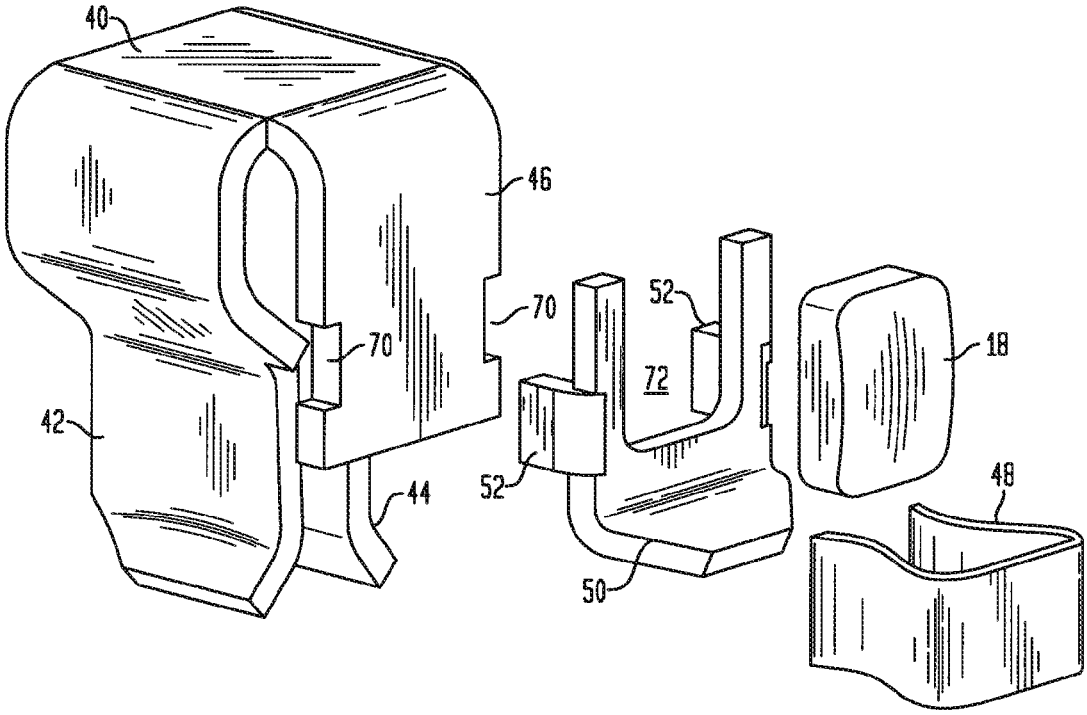
FIG. 7 is a perspective view of a disassembled line terminal in accordance with one illustrative embodiment.

Referring to FIG. 7, a disassembled line terminal is illustratively depicted. The disassembled line terminal includes the body 40 which is preferably formed from stamped sheet metal, and legs 42, 44 and 46 are bent into the proper configuration using a suitable metal forming process. Arc runner 50 includes tabs 52 which are received in recesses 70 on opposing sides of leg 46. Fixed contact 18 is attached to leg 46 and sits within a recess 72 formed in arc runner 50. Spring clip 48 is shown and is employed to bias legs 42 and 44 when assembled.

Having described preferred embodiments for a self-adjusting plug-in line terminal (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A line terminal for a circuit breaker, comprising:

a body forming two opposing legs and a third leg;

the opposing legs being configured to form a passage for receiving a stab from a panel board, the two opposing legs being biased toward each other and each of the opposing legs having a convex surface facing the passageway for engaging and maintaining alignment of the stab;

a fixed contact being attached to the third leg, the fixed contact for connecting to a moveable contact of a circuit breaker; and an arc runner being connected to the third leg and at least partially enclosing a perimeter of the fixed contact.

2. The line terminal as recited in claim 1, wherein the arc runner includes an angled end portion for directing arcs away from the fixed contact.

3. The line terminal as recited in claim 1, wherein the arc runner includes a ferromagnetic material such that a reverse current path is formed when to create a magnetic blow off force during a tripping event of the circuit breaker.

4. The line terminal as recited in claim 1, wherein the two opposing legs are biased using a spring clip.

5. The line terminal as recited in claim 1, wherein the convex surfaces include at least two protrusions for each of the opposing legs.

6. The line terminal as recited in claim 5, wherein the at least two protrusions on each of the opposing legs are aligned in a direction perpendicular with an insertion direction of the stab.

7. The line terminal as recited in claim 1, wherein the opposing legs have end portions angled outwardly for receiving the stab.

8. The line terminal as recited in claim 1, wherein the fixed contact is enclosed by the arc runner to maintain a shape of the fixed contact within the arc runner.

9. The line terminal as recited in claim 8, wherein the fixed contact includes silver to provide a soft non-stick contact surface.

10. A circuit breaker, comprising:

a moveable contact connected to an arm and configured to move to cause an open circuit in accordance with a current condition;

a line terminal having a body forming two opposing legs and a third leg;

the opposing legs being configured to form a passage for receiving a stab from a panel board, the two opposing legs being biased toward each other and each of the opposing legs having a convex surface facing the passageway for engaging and maintaining alignment of the stab;

a fixed contact being attached to the third leg, the fixed contact for connecting to the moveable contact; and an arc runner being connected to the third leg and at least partially enclosing a perimeter of the fixed contact.

11. The circuit breaker as recited in claim 10, wherein the arc runner includes an angled end portion for directing arcs away from the fixed contact.

12. The circuit breaker as recited in claim 10, wherein the arc runner includes a ferromagnetic material such that a reverse current path is formed when to create a magnetic blow off force during a tripping event of the circuit breaker.

13. The circuit breaker as recited in claim 10, wherein the two opposing legs are biased using a spring clip.

14. The circuit breaker as recited in claim 10, wherein the convex surfaces include at least two protrusions for each of the opposing legs.

15. The circuit breaker as recited in claim 14, wherein the at least two protrusions on each of the opposing legs are aligned in a direction perpendicular with an insertion direction of the stab.

16. The circuit breaker as recited in claim 10, wherein the opposing legs have end portions angled outwardly for receiving the stab.

17. The line terminal as recited in claim 10, wherein the fixed contact is enclosed by the arc runner to maintain a shape of the fixed contact within the arc runner.

18. The line terminal as recited in claim 10, wherein the fixed contact includes silver to provide a soft non-stick contact surface.

* * * * *